US006351891B1

(12) United States Patent
MacGugan

(10) Patent No.: US 6,351,891 B1
(45) **Date of Patent: *Mar. 5, 2002**

(54) MINIATURE DIRECTIONAL INDICATION INSTRUMENT

(75) Inventor: Douglas C. MacGugan, Bellevue, WA (US)

(73) Assignee: Honeywell International, Inc., Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/205,203

(22) Filed: Dec. 3, 1998

Related U.S. Application Data

(60) Provisional application No. 60/068,020, filed on Dec. 18, 1997.

(51) Int. Cl.[7] ..... E21B 47/022

(52) U.S. Cl. ..... 33/304; 33/312

(58) Field of Search ..... 33/302, 304, 312, 33/313, 315

(56) References Cited

U.S. PATENT DOCUMENTS

| | | | | | |
|---|---|---|---|---|---|
| 3,862,499 | A | * | 1/1975 | Isham et al. | 33/312 |
| 4,163,324 | A | * | 8/1979 | Russell et al. | 33/313 |
| 4,459,759 | A | * | 7/1984 | Hulsing, II | 33/312 |
| 4,505,048 | A | * | 3/1985 | Sharp | 33/313 |
| 4,542,647 | A | | 9/1985 | Molnar | 73/151 |
| 5,321,893 | A | * | 6/1994 | Engebretson | 33/304 |
| 5,435,069 | A | * | 7/1995 | Nicholson | 33/304 |
| 5,467,083 | A | | 11/1995 | McDonald et al. | 340/854.6 |
| 5,537,753 | A | * | 7/1996 | Otte et al. | 33/304 |
| 5,657,547 | A | * | 8/1997 | Uttecht et al. | 33/304 |
| 6,065,219 | A | * | 5/2000 | Murphey et al. | 33/302 |

OTHER PUBLICATIONS

Robert Desbrandes: "Status Report: MWD Technology"; *Petroleum Engineer International*, vol. 60, No. 9, Sep. 1998 p. 27–33 XP–002102062.

* cited by examiner

*Primary Examiner*—G. Bradley Bennett

(57) ABSTRACT

A miniature directional indication sensor system capable of operating at elevated temperature. A directional indication sensor system is less than 1 inch in diameter and 7 inches in length. The directional sensor system provides angle measurement in applications from which current larger directional sensors are barred. The present invention provides increased shock and vibration resistance. The chassis of the present invention has an high resonant frequency, or "Q". The present invention is implemented with power supply, sensor drive and sense circuits in thick film or multi-chip module electronic assemblies. The thick film or multi-chip module electronics assemblies also contribute to the increased shock and vibration resistance. Sensor drive and sense functions may be implemented in one or more application specific integrated circuits and integrated with multi-chip module electronics assembly. Analog-to-digital conversion of sensor signals is implemented in a voltage-to-frequency converter circuit provided by the present invention. Furthermore, the present invention eliminates data lag between channels by providing simultaneous sampling of all the sensor channels.

15 Claims, 15 Drawing Sheets

POWER IN
RTN
POWER REGULATORS
64
+V
GND
-V
16a
16b
16c
x ACCEL
y ACCEL
z ACCEL
600
MIXER/ FILTER
236
214
SERIAL OUT
BUFFER
DATA BUS
210
226
TIMER SAMPLE
1/9
3 BANK 13-BIT+3-ALU COUNTERS
4 BANK 18-BIT/16OUT COUNTERS
8 CHANNEL MUX
UART
273k
228
19.2k clk
212
222
1/2
1.23 MHz clk
2.4576 MHz CLOCK
1/25
98.3k clk
V/F CONVERTERS
224
216
220
MOSFET
242
DRIVE ELECTRONICS
TEMP SENSOR
218
234
244
200
x MAC
y MAC
z MAC
54

MINIATURE DIRECTIONAL INDICATION INSTRUMENT

RELATED APPLICATIONS

This application claims priority from U.S. Provisional Application Serial No. 60/068,020 filed Dec. 18, 1997.

BACKGROUND OF THE INVENTION

The invention relates to a directional indication instrument, in particular to a miniature directional indication drilling instrument capable of operation at elevated temperatures.

The oil and gas well drilling and survey fields as well as many other fields of industry require highly accurate and highly reliable measuring instruments and sensors. Measuring instruments and sensors used in the oil and gas well drilling and survey fields and many other industries, for example, aircraft equipment and military ordinance, must survive and operate accurately in extreme environmental conditions including, for example, extreme vibrations and impacts experienced at temperatures ranging from well below freezing to hundreds of degrees Centigrade. In these applications, measuring instruments and sensors are often tested for operation in broadband vibration environments as extreme as 20 g RMS; shock or impact environments in the range of 2,000 g's; and temperature extremes ranging from −40 to +200 degrees Centigrade.

Well drilling and logging operations typically require that very expensive equipment and highly skilled workers operate in remote locations. This combination of factors results in operating costs that may run half a million dollars or more per day. Thus, an equipment failure which forces operations to shut-down may be very costly. To limit the costs associated with equipment failures, many operators keep spare parts on hand, including spare measuring instruments and sensors, even though the spare parts may be very expensive themselves. Such costly operations in such extreme environmental conditions demand sensors and measuring instruments which are compact, very rugged and highly reliable.

In the oil and gas industry, well drilling and logging environments have become even more severe as deposits are sought in ever deeper boreholes. The deeper the borehole the more extreme the temperature in which the drill string and drill string steering tools must operate. Directional drilling is often employed in which the boreholes contain changes in direction at various points along their depth. For example, the borehole may change from vertical to horizontal for short distances. Deep and angular boreholes often require the measuring instrument or sensor guiding the drill string to operate in very small spaces which may be one inch or less in diameter. Current directional instruments, however, are too large to operate effectively in these applications. For example, current instruments are typically 1.25 to 1.5 inch in diameter.

The directional drilling process uses sensing instruments incorporated into sensing systems which are placed downhole with the drilling bit to determine the location, direction and rate of change in position of the bit. Current direction sensor systems used in energy exploration are typically a complicated mix of sensors and electronics. Typical directional sensor systems are composed of separate acceleration and magnetic field sensors with discrete electronics providing input power and drive signals and sensing output signals. Typically, the separate sensors and electronic assemblies are mounted together on a single chassis.

Deeper boreholes require smaller diameter drill pipe and high temperature directional sensing systems which places a new and heavier burden on the current generation of directional sensing equipment. Size restrictions prohibit the use of current generation directional sensing equipment in many deep borehole drilling systems. The current large diameter directional sensing systems can not be placed in the drill stem bore without severely comprising other operations, such as drilling mud flow around the drilling and directional sensing systems. In deeper holes, the sharper turn radius required for horizontal drilling operations places additional length limitations on directional sensor systems. The long length of current directional sensor systems, typically on the order of 24 inches, limits the turn radius.

Use of electronics packages comprised of discrete electronic components to provide input power and drive signals and to sense output signals in current directional sensing systems limits the shock and vibration environments to which current instruments may be exposed. For example, lengthy wire bonds between discrete electronic components and printed wire boards combined with the inherent vibration sensitivity of printed wire boards limit both the operational and survival shock and vibration exposure limits of current instruments. Interconnect wiring between the various electronic packages and the sensors further limits the shock and vibration environments to which current instruments may be exposed.

Current directional instruments are typically limited to operate in temperature environments of +150 degrees Centigrade or less. Thus, current directional instruments are too temperature sensitive to operate effectively in environments in excess of +150 degrees Centigrade. For example, current instruments are too temperature sensitive to operate in deeper, hotter borehole applications. Differing coefficients of thermal expansion coefficients between components used in sensing instruments result in increased noise and other limitations. For example, differences in the thermal expansion coefficients of the package material and the acceleration sensor mechanism induces strain in accelerometers which reduces sensor accuracy and performance. Additionally, typical discrete packaged electronics breakdown during operation at high temperatures in excess of 150 degrees Centigrade.

Additionally, current directional sensing systems provide analog sensor signal voltages which require analog-to-digital conversion before signal transmission to the surface. In practice, analog-to-digital converter circuits in a drill string-mounted microprocessor may contribute large modeling errors.

SUMMARY OF THE INVENTION

The present invention overcomes the limitations of the prior art by providing a smaller directional indication sensor system of novel design capable of operating at elevated temperature. According to one aspect of the present invention, the present invention provides a directional indication sensor system which measures, for example, significantly less than 1 inch diameter as compared with the 1.25 to 1.50 inches diameter typical of current directional sensor systems and measures 7 inches in length as compared with 18 to 24 inches of typical directional sensor systems. Thus, a directional sensor system of the present invention provides angle measurement in applications from which current larger directional sensors are barred.

Additional advantages inherent in the smaller directional sensor system of the present invention include, for example, increased shock and vibration resistance. For example, the direction indication system of the present invention is more compact than current directional sensor systems, having a diameter under 1 inch and a length of 7 inches as compared with devices having diameters of 1.25 to 1.5 inch and a length of 18 to 24 inches. Thus, the system chassis has an inherently higher resonant frequency, or "Q," than the chassis of current systems. Current directional indication systems are 5 to 10 times larger in volume than the device of the present invention. Thus, the directional indication system of the present invention has an increased shock and vibration resistance as a result of its inherently lower mass.

In part, the compactness of a directional indication system according to the present invention is due to the implementation of power supply and sensor drive and sense circuits in thick film or multi-chip module electronic assemblies. The thick film or multi-chip module electronics assemblies also contribute to the increased shock and vibration resistance of the directional sensor system of the present invention. For example, thick film or multi-chip module electronic assemblies are more compact and have smaller component size and shorter wire bonds than comparable circuits implemented using discrete components mounted on printed wiring boards. Additionally, the more compact multi-chip module electronics assembly or hybrid electronics assembly lends itself to more effective shock and vibration isolation mounting than is possible with current technology which uses discrete packaged integrated circuits on a printed wiring board. Sensor drive and sense functions may be implemented in one or more application specific integrated circuits and integrated with multi-chip module electronics assembly for even greater compactness. Such measures as implementing sensor drive and sense circuits in one or more multi-chip module electronics assemblies provides reduced noise and allows the control electronics to be co-located with respective sensors.

According to yet another aspect of the present invention, micro-electronics are utilized to improve the reliability of the sensor system's electronic features, including the sensor system's main electronics package. For example, the sensor system electronics package may be implemented in one or more hybrid electronics packages. In one example, power regulation, isolation, and filtering functions are implemented in one or more hybrid electronics packages. In another example, a digital controller chip provided on the main system electronics module controls the functions of the directional sensing system of the present invention. A main system electronics module provides serial digital output signals of the direction sensors which include three orthogonally mounted accelerometers, a three-axis magnetometer, a temperature signal output and a status word.

According to another aspect of the present invention, the present invention overcomes inherent temperature limitations of the prior art by providing a directional indication sensor system capable of operation at a higher temperature than current directional indication sensor systems. The present invention provides a directional indication sensor system capable of operation at elevated temperature, for example, 200 degrees Centigrade. The improved temperature capabilities provided by the present invention are another advantage derived by through use of power supply and drive and sense circuits in thick film or multi-chip module electronic assemblies and replacing discrete integrated circuits with application specific integrated circuits. Thus, the present invention provides a miniature directional indication sensor system which is capable of operating at elevated temperatures and within typical environmental shock and vibration regimes while providing the same or better performance as larger, temperature limited directional indication sensor systems.

According to still another aspect of the present invention, a miniature directional indication sensor system provides enhanced accuracy by providing serial digital output signals representative of direction and thermal sensors. Analog-to-digital conversion of sensor signals is implemented in a voltage-to-frequency converter circuit provided by the present invention. Furthermore, a miniature directional indication sensor system according to the present invention eliminates data lag between channels by providing simultaneous sampling of all the sensor channels.

DETAILED DESCRIPTION OF THE PREFERRED EMBODIMENT(S)

Figure 1A:
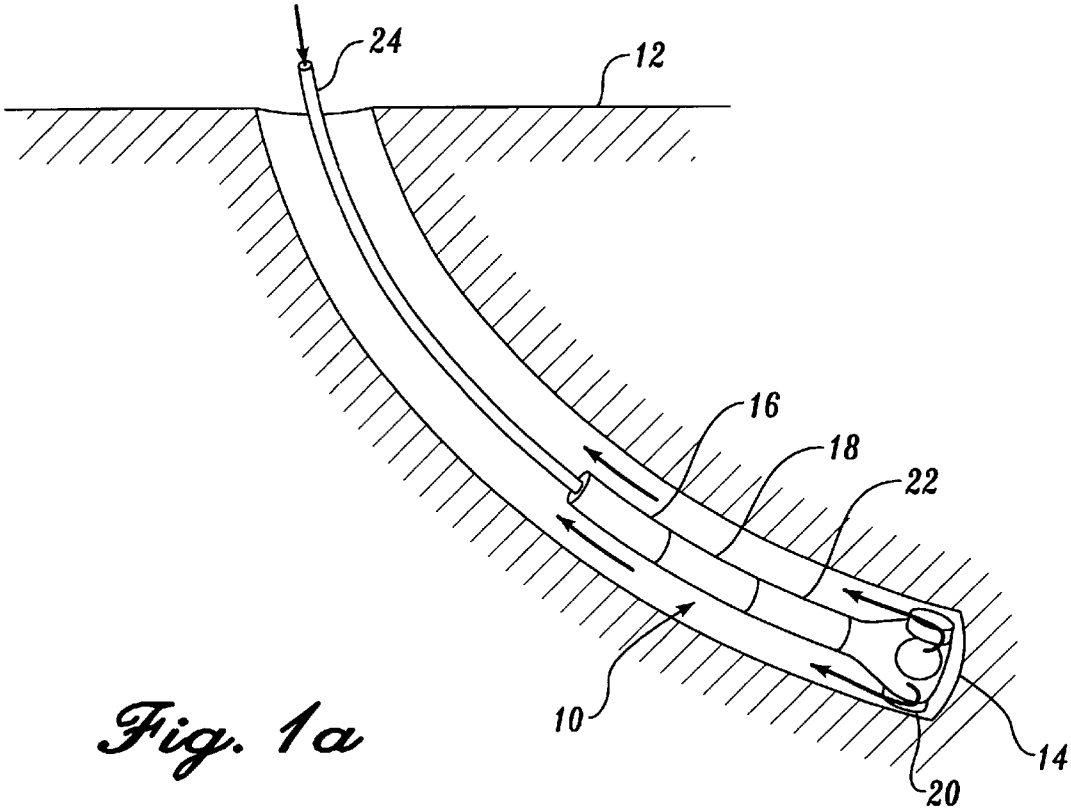
FIG. 1*a* illustrates a first representative environment for one alternative embodiment of the present invention.

FIG. 1*a* illustrates a representative well drilling environment for one preferred embodiment of the present invention wherein the invention is used to guide the drill system 10 during the initial drilling of the borehole, a technique also known as "measure while drilling" or "MWD." Extending below the ground 12 is a borehole generally indicated at 14. Drill system 10, also known as a drill string, used to drill borehole 14 includes, for example, four sections: a user supplied microprocessor 16; the miniature directional indication system 18 of the present invention which is described in detail below; and a drill bit 20 driven by a mud motor 22. Drill system 10 may include additional user supplied equipment, for example, miscellaneous user supplied electronics packages.

The first drill system section, microprocessor 16, is connected to a tube 24. Tube 24 serves to supply the drilling fluid or drilling "mud" to mud motor 22. The drilling fluid or "mud" is supplied to drill system 10 under pressure through tube 24. The pressurized drilling fluid or "mud" flows along tube 24 and through drill system 10 and mud motor 22 before flowing back around the outside of drill system 10 and back along borehole 14 outside tube 24 as indicated by the arrows in FIG. 1*a*, filling borehole 14. The drilling fluid or "mud" additionally provides a transmission medium for transmitting data from drill system 10 to the surface. Signals may be transmitted between directional indication instrument 18 and the wellhead by, for example, pressure impulses that are transmitted through the drilling fluid or "mud" that fills borehole 14.

The miniature sensor system more easily fits inside the smaller diameter drill systems used in deep drilling operations. The present invention utilizes specially developed sensors and ceramic substrate micro-electronics, as described below, which perform at the elevated temperatures experienced in deep wells and can survive the extreme shock and vibration environment of deep drilling. The miniature sensor system of the present invention is also suitable for directional drilling.

Figure 1B:
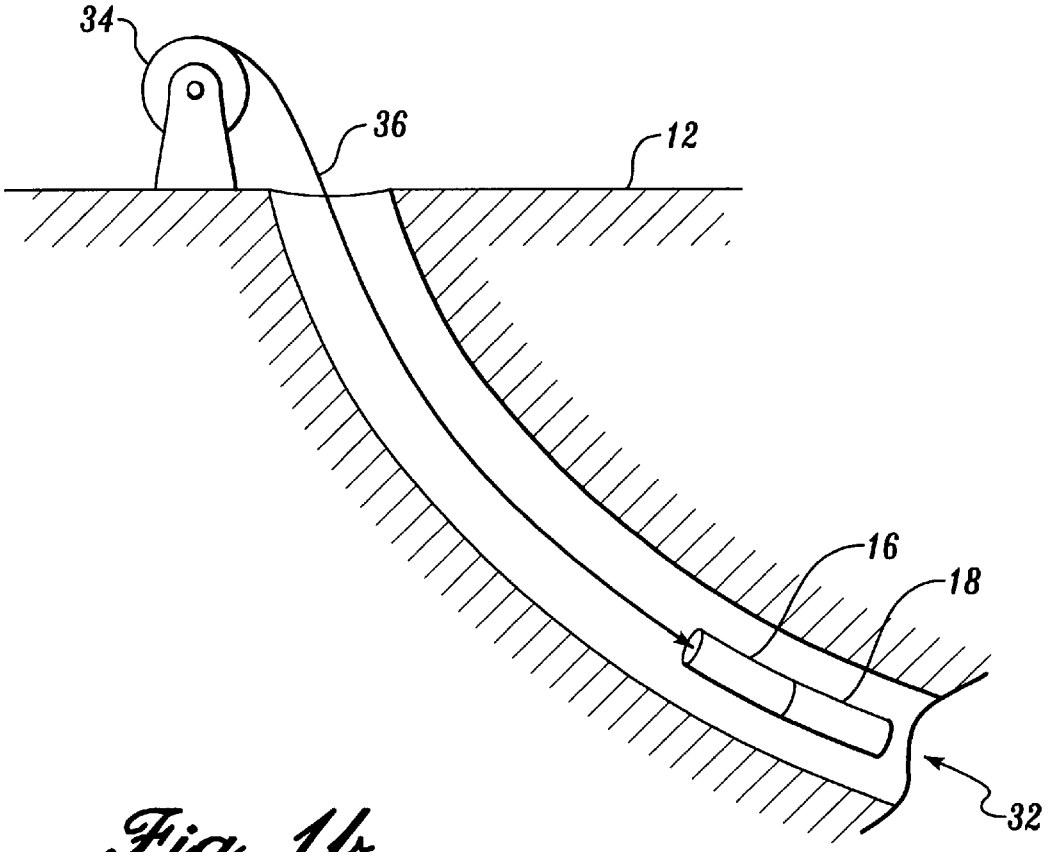
FIG. 1*b* illustrates a second representative environment for one alternative embodiment of the present invention.

FIG. 1*b* illustrates a representative wireline survey or "well logging" environment for one preferred embodiment of the present invention wherein the invention is used to map or "log" an existing borehole. Extending below the ground 12 is an existing borehole generally indicated at 32. Inserted into borehole 32 for movement through borehole 32 is a probe that includes, for example, two sections: the first section is a user supplied microprocessor 16; the second section is the miniature directional indication system 18 of the present invention which is described in detail below. The first probe section, microprocessor 16, is connected to a cable reel 34 by means of cable 36. Cable 36 serves to lower the probe through borehole 32. In an exemplary illustration, cable 36 additionally provides a transmission medium for transmitting data from the probe to the surface over cable 36. Cable 36 may, for example, be of conventional construction: a multi-stranded flexible steel cable having a core consisting of one or more electrical conductors.

Typical borehole survey applications use hardwire pull-up lines, i.e., core electrical conductors in cable 36 of FIG. 1*b*, to interface between the directional sensor and the borehole entrance, or wellhead, and transmit information signals from microprocessor 16 or directional indication instrument 18 to the wellhead. Typical "measure while drilling" applications use pressure impulses transmitted through the drilling fluid or "mud" that fills borehole 14 to transmit information signals from microprocessor 16 or directional indication instrument 18 to the wellhead.

In practice, microprocessor 16 is typically located in the borehole directly behind directional indication instrument 18. In a preferred embodiment, the invention provides a direct digital interface to microprocessor 16. Communication may be via either a parallel or a serial interface. For example, a bus structure outputs eight 16-bit data words: a synchronization/identification word; three magnetometer words, one for each of three axes; one temperature word; and three accelerometer words, one for each of three axes. In one embodiment, a parallel data bus (not shown) provides the digital interface between directional indication instrument 18 and microprocessor 16. An embodiment of the invention using a parallel data bus to provide a direct digital interface uses a sixteen wire interface between microprocessor 16 and directional indication instrument 18, one wire for each of the sixteen bit data words. An alternative embodiment using a parallel data bus provides an 8-bit parallel data bus with an eight wire interface which excludes reciprocal communications. In another embodiment, Use of a data bus, for example, a serial bus using RS 232-type architecture, outputting 16 bit data words provides a system configuration having a two wire interface: a transmit wire and a ground wire. Alternatively, the invention includes a third wire for reciprocal "handshake" communication between microprocessor 16 and directional indication instrument 18.

Figure 2:
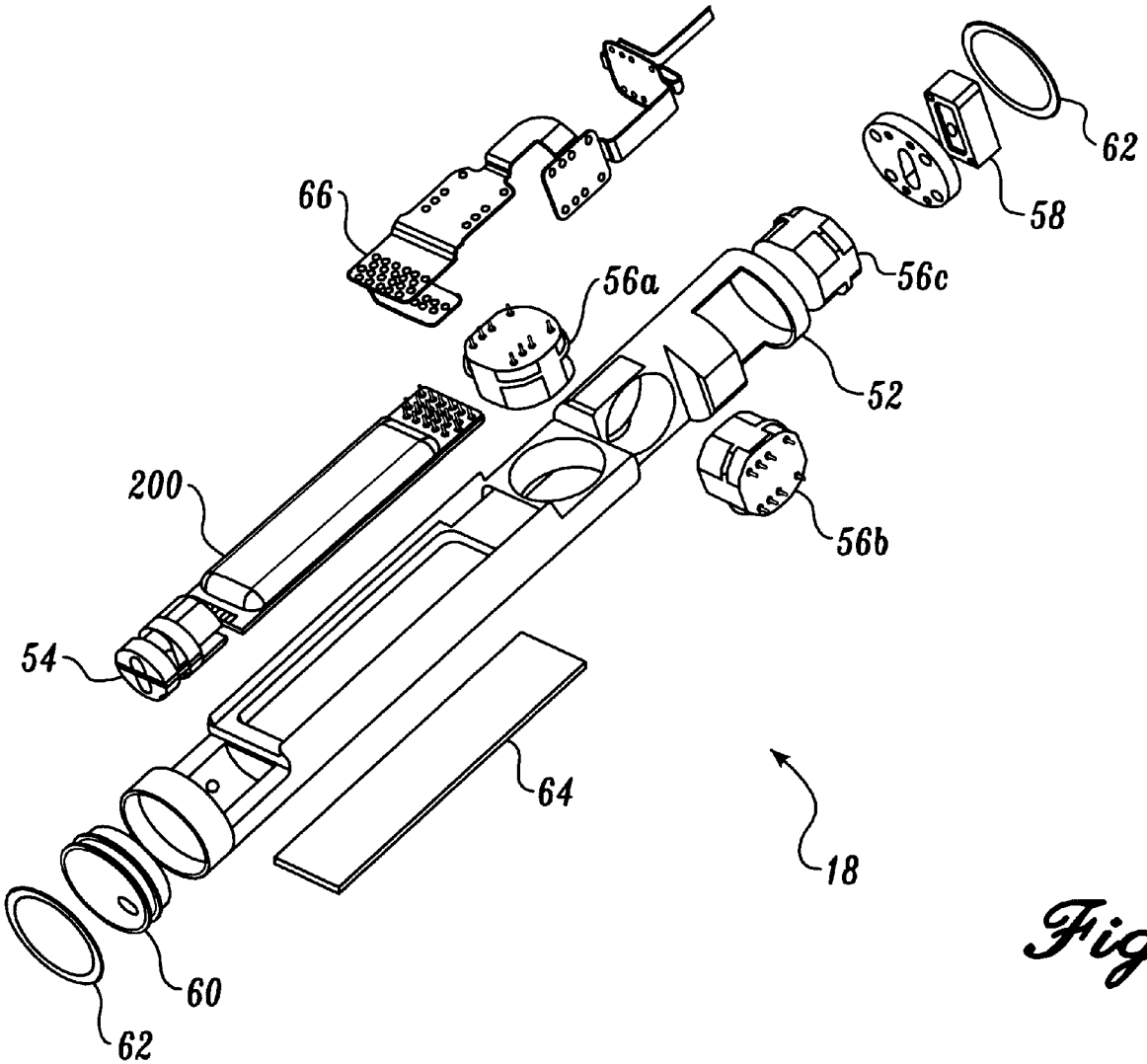
FIG. 2 illustrates one alternative embodiment of the present invention in an exploded view.

According to the embodiment depicted in FIG. 2, directional indication sensor system 18 of the present invention provides a sturdy, reliable chassis 52 which is manufactured of a suitable non-magnetic material, for example, aluminum. Two triads of directional sensors 54, 56 are mounted in chassis 52. A first triad is a mutually orthogonal three axis magnetometer 54 for indicating the component of the Earth's magnetic field in each of three orthogonal axes. A second triad comprises three linear accelerometers 56*a*, 56*b*, 56*c* mounted in chassis 52 to have mutually orthogonal input axes X, Y, Z, respectively, which indicate the components of the Earth's gravity vector in each of the three axes.

According to one embodiment of the present invention, chassis 52 is sized such that overall sensor system dimensions of 7 inches in length results, inclusive of an electronic connector 58 for inputting power and outputting sensor signals and an indexing plug 60 for aligning the reference axes with external equipment. In contrast, a typical directional indication drilling instrument is 24 inches in length. Chassis 52 also provides an overall sensor diameter of 0.85 inches, exclusive of centering o-rings 62, compared with typical sensor diameters of 1.25 inch or more. A single sturdy, reliable chassis mount improves vibration and shock or impact operational and survival capability. For example, chassis 52 is preferably formed as a single unit which maximizes shock and vibration resistance by maximizing the resonant frequency, or "Q," of chassis 52.

The present invention utilizes micro-electronics to improve the reliability of the sensor system's electronic features. For example, power regulation, isolation, and filtering functions are implemented in one or more hybrid electronics packages. In another example, the main system electronics module, which provides serial digital output signals of the direction and thermal sensors and is described in detail later, is implemented in one or more hybrid electronics packages. Hybridization of complex circuits provides higher component density by "stacking" the conductive traces, which carry signals between the various components, vertically on separate layers such that traces can cross one another and can be routed under circuit components without interference or "cross talk."

Figure 3:
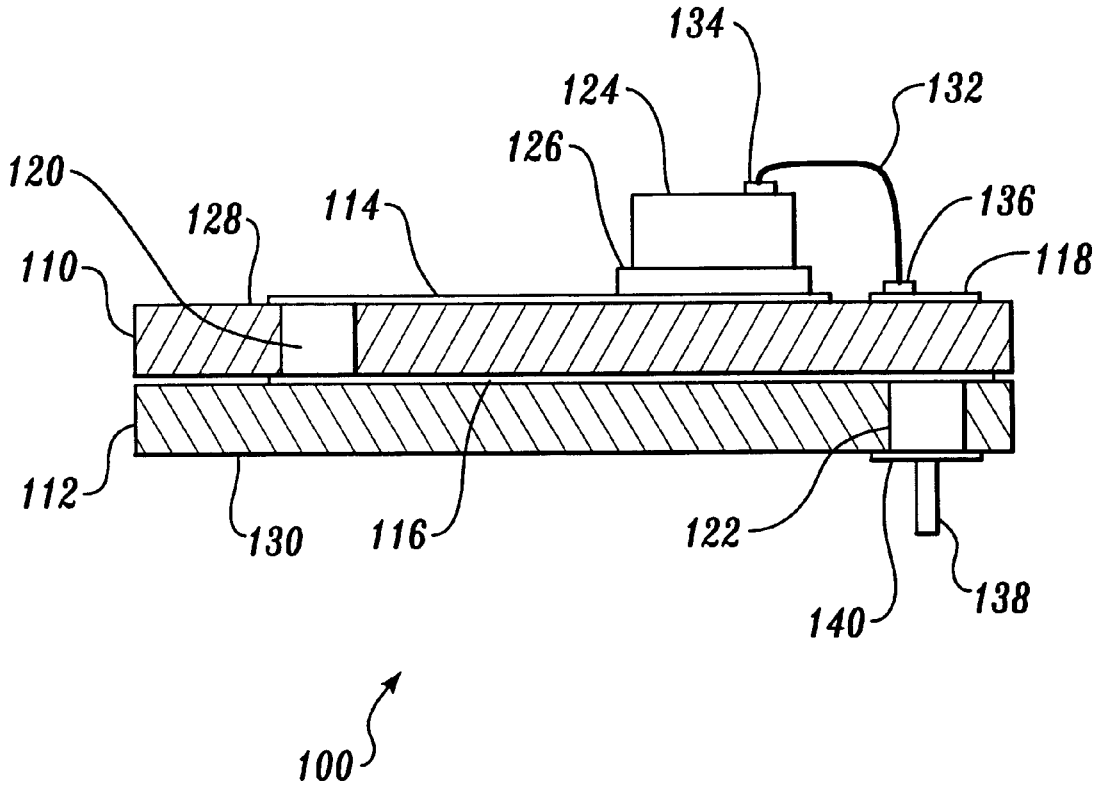
FIG. 3 illustrates an example of a two layer hybrid electronics package or multi-chip module.

FIG. 3 illustrates an example of a two layer hybrid electronics package or multi-chip module. Those of skill in the art will appreciate that in practice a hybrid electronics package may be implemented in as many as 30 or more layers depending on the complexity of the circuit. The hybrid electronics package 100 of FIG. 3 comprises, for example, substrates 110 and 112 which may be formed of any suitable material, for example, ceramic. Traces 114, 116, 118 are silk screened onto each surface of substrates 110, 112 in a pattern which routes signals according to the circuit design. Traces 114, 116 are formed using a paste formed of a suitable conductive material, for example, gold. Holes or "vias" 120, 122 punched in substrates 110, 112 are filled with the conductive paste to electrically connect trace 114 on a first layer formed by substrate 100 to trace 116 on a second layer formed by substrate 112. After silk screening, substrates 110, 112 are vertically stacked with traces 114, 116, 118 and vias 120, 122 aligned and the stack is baked or "fired" to form an essentially solid block of substrate material interleaved with conductive traces.

Components or die 124, each mounted on its own solder pad 126, are mounted on one or more surfaces 128, 130. Components 124 are accessed by bonding conductors 132, for example, gold wires, between wire bond pads 134 on component 124 and wire bond pads 136 on substrate 110. One or more pins 138, each mounted on its own solder pad 140, are mounted on one or more surfaces 128, 130. Pins 132 provide for signal input and output for the resulting hybrid circuit 100.

Figure 4:
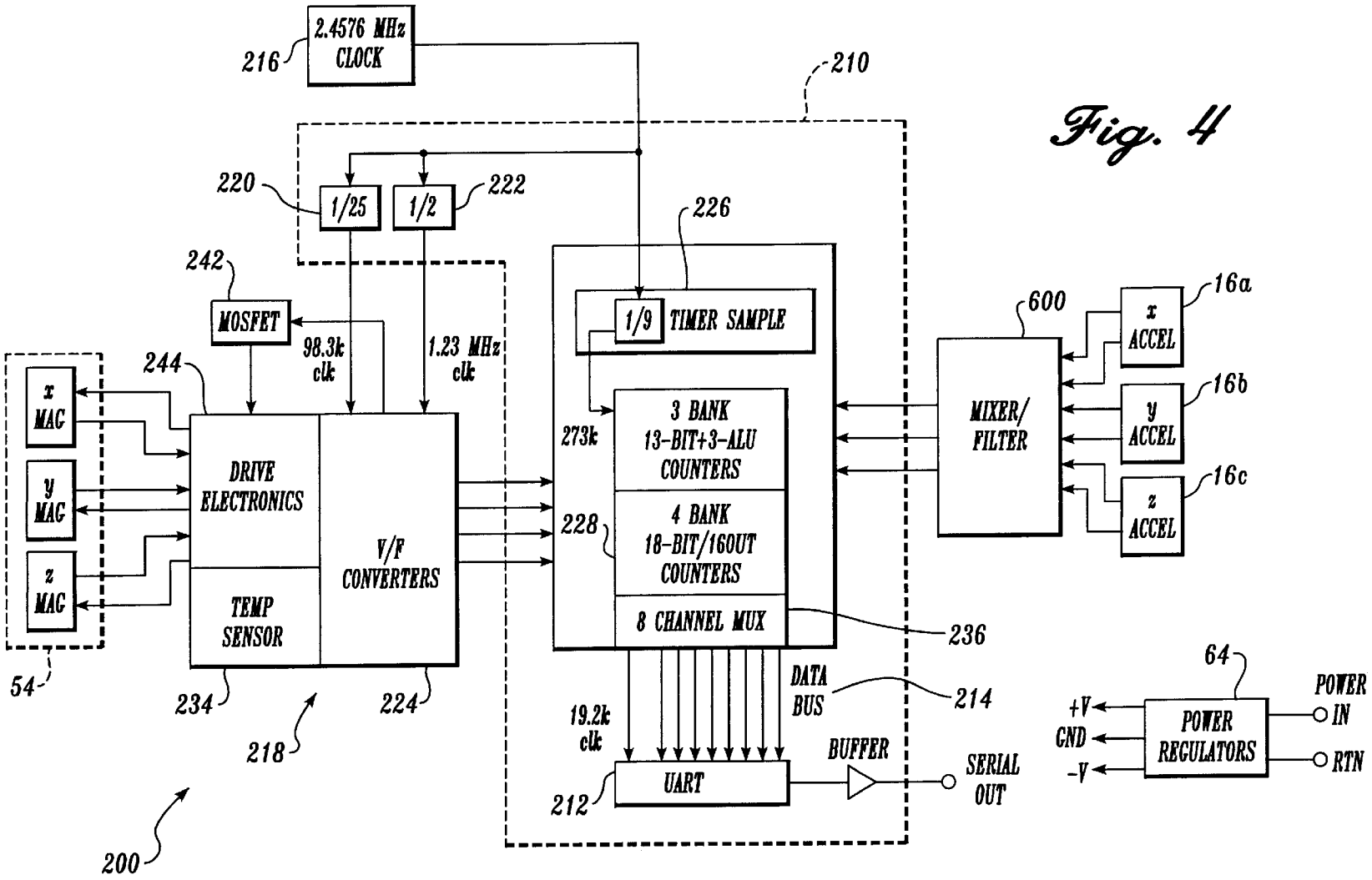
FIG. 4 illustrates an exemplary block diagram of self-contained miniature electronics according to an embodiment of the present invention.

FIG. 4 illustrates an exemplary block diagram of self-contained miniature electronics which power and sense the two triads of directional sensors included in the directional indication instrument of the present invention. Implementing main system electronics module 200 in an integrated low temperature co-fired ceramic substrate allows denser circuit layout than is possible using conventional thick film hybrid techniques. The advantages of micro-electronics may be realized when integrated digital circuit 210 is implemented in digital format in a first digital application specific integrated circuit (ASIC). According to one aspect of the present invention, main system electronics system 200 is implemented in a hybrid circuit which includes several active components mounted on an integrated low temperature co-fired ceramic (LTCC) substrate, also known in the art as a multi-chip module.

One or more electronic assemblies provide the electronic functions of directional instrument 18. For example, the electronic assemblies may be implemented in one or more thick film or multi-chip module (MCM) electronic assemblies. According to one embodiment of the present invention, two thick film or multi-chip module electronic assemblies are used to implement the electronic circuits. A first electronic assembly is a conventional power regulator 64 implemented in a thick film electronics hybrid. Power regulator 64 converts a single sided input power having a voltage level in the range of +14.5 Vdc to +28 Vdc into regulated system and sensor power. A flexible circuit interconnect 66 routes the input power and sensor output signals among the various system components.

A second electronic assembly is a main system electronics module 200. Main system electronics module 200 gathers the sensor signals and converts the signals into digital format for transmission over an internal conventional universal asynchronous receiver transmitter (UART). In a preferred embodiment, main system electronics module 200 contains three integrated circuits.

Figure 5:
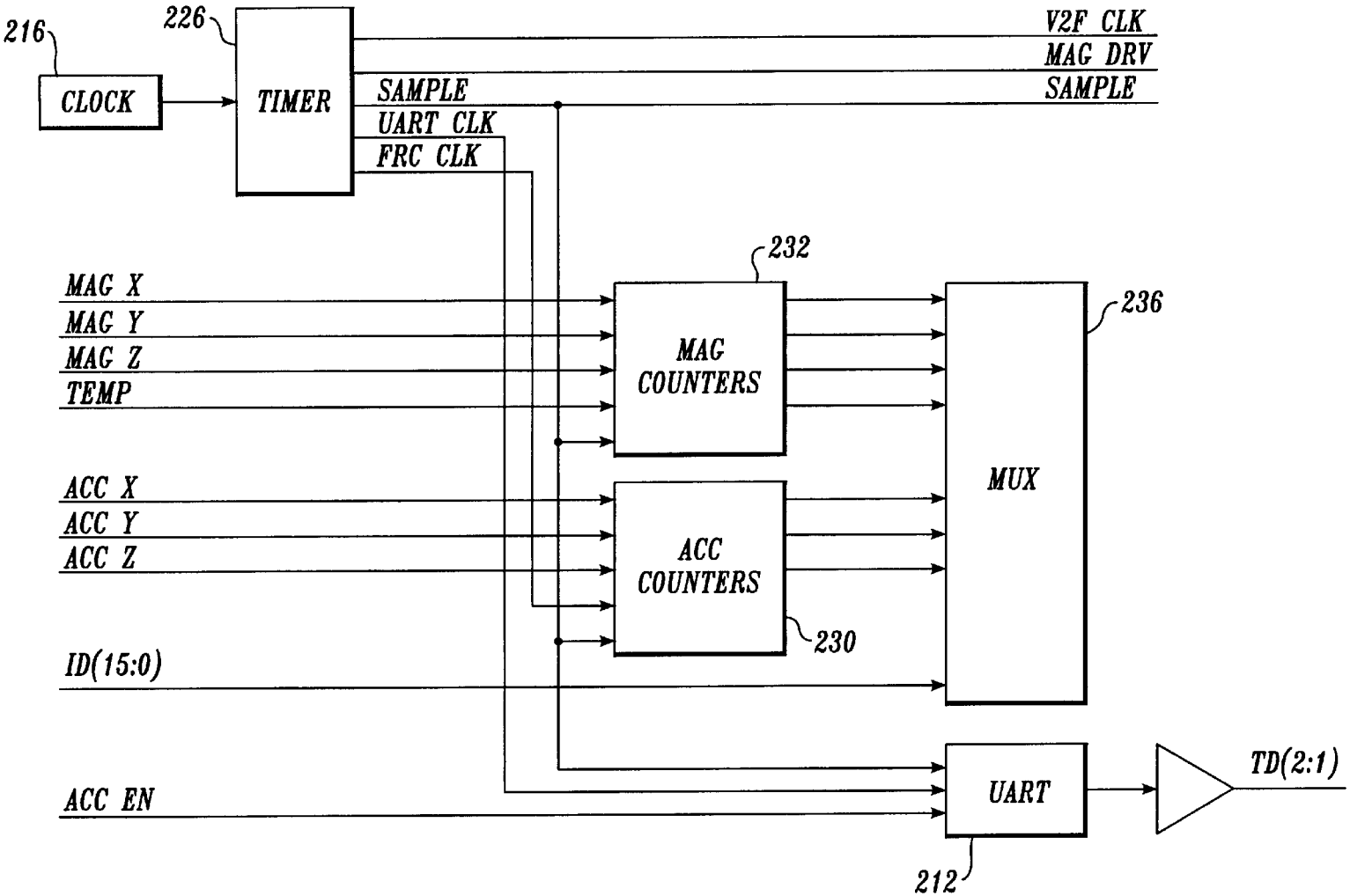
FIG. 5 is an illustrative example of signal routing according to an embodiment of the present invention.

A first integrated circuit, integrated digital circuit 210, is a 7-bank integrated circuit, including a counter, timers, and a sequencer. FIG. 5 is an illustrative example of the signal routing of integrated digital circuit 210. Integrated digital circuit 210 operates the sensor system: gathering the sensor signals and converting the signals into digital format for transmission over internal conventional UART 212 for direct serial data interface through a serial port. UART 212 is addressed via internal 8-bit parallel data bus 214.

Magnetometer 54 and temperature sensor 234 frequency signals generated by integrated control circuit 218 are counted or sampled in integrated digital circuit 210 over the sample rate. The frequency counting circuits internal to integrated digital circuit 210 convert the frequency signals to digital signals having sixteen bit resolution. In a preferred embodiment, the invention also provides selectable data and sample rates. For example, the data rate is selectable up to 19.2 kBaud. The sample rate may also be made selectable. For example, in one preferred embodiment, the sample rate is selectable at 1 Hz, 10 Hz, 20 Hz and 100 Hz. Those of skill in the art will appreciate that the data rate and sample rate may be made selectable at other sample rates.

Integrated digital circuit 210 continuously counts the sensor signals and formats the signals for application to UART 212 before transmitting the sensor signals over the serial port. A CMOS system clock 216 operating at 2.4576 Mhz feeds integrated digital circuit 210. Integrated digital circuit 210 counts down system clock 216 to provide the various operating timing signals for operation of a magnetometer integrated control circuit 218, internal UART 212, and the internal counters. For example, divider circuits 220, 222 reduce the clock signal to 98.3 Khz and 1.23 Mhz, respectively, and feed the reduced clock signal to magnetometer voltage-to-frequency converter 224.

CMOS system clock 216 feeds a timer 226 portion of integrated digital circuit 210 where the clock signal is 1/9 divided such that a 273 Khz clock signal is fed to a counter portion 228. Counter portion 228 includes a first counter circuit 230 for timing accelerometer 56 output signals and a second counter circuit 232 for timing magnetometer 54 and temperature sensor 234 output signals.

Integrated digital circuit 210 includes an 8-channel multiplexer 236 which sequentially routes the digital outputs to UART 212 for serial transmission over the serial interface to microprocessor 16. Integrated digital circuit 210 uses conventional frequency counting techniques to provide analog-to-digital conversion which eliminates the need for microprocessor 16 to include either several analog-to-digital converters or a multiplexer switch and analog-to-digital converters. In practice, analog-to-digital converter circuits in microprocessor 16 may contribute large modeling errors. Thus, the frequency counting circuits internal to integrated digital circuit 210 provide enhanced accuracy. Furthermore, integrated digital circuit 210 provides simultaneous sampling of all the accelerometer and magnetometer channels. Thus, no data lag occurs between channels. In contrast, a multiplexer-based microprocessor requires dedicated analog-to-digital converters for each channel to avoid lag between channels which adds expense as well as decreasing modeling accuracy by contributing the afore detailed large modeling errors.

Ring Core Flux Gate Magnetometer

Magnetic field sensors measure the Earth's natural magnetic field. Typical ring core flux gate magnetometers lose accuracy and have increased noise as size is reduced. Directional indication instrument 18 includes a magnetic field sensor, magnetometer 54. Magnetometer 54 is a three-axis ring core flux gate magnetometer having a diameter about half that of current ring core flux gate magnetometers. Magnetometer 54 is 0.5 inch in diameter and 0.75 inch in length compared with a typical magnetometer sensor having a diameter of 1 inch and a length of 4 inches. When operated at 200 degrees Centigrade, magnetometer 54 performs as well as or better than currently fielded devices which are 5 to 10 times larger in volume. One embodiment of the present invention provides a small diameter magnetic field sensor using integrated drive and sense electronics.

Figure 6:
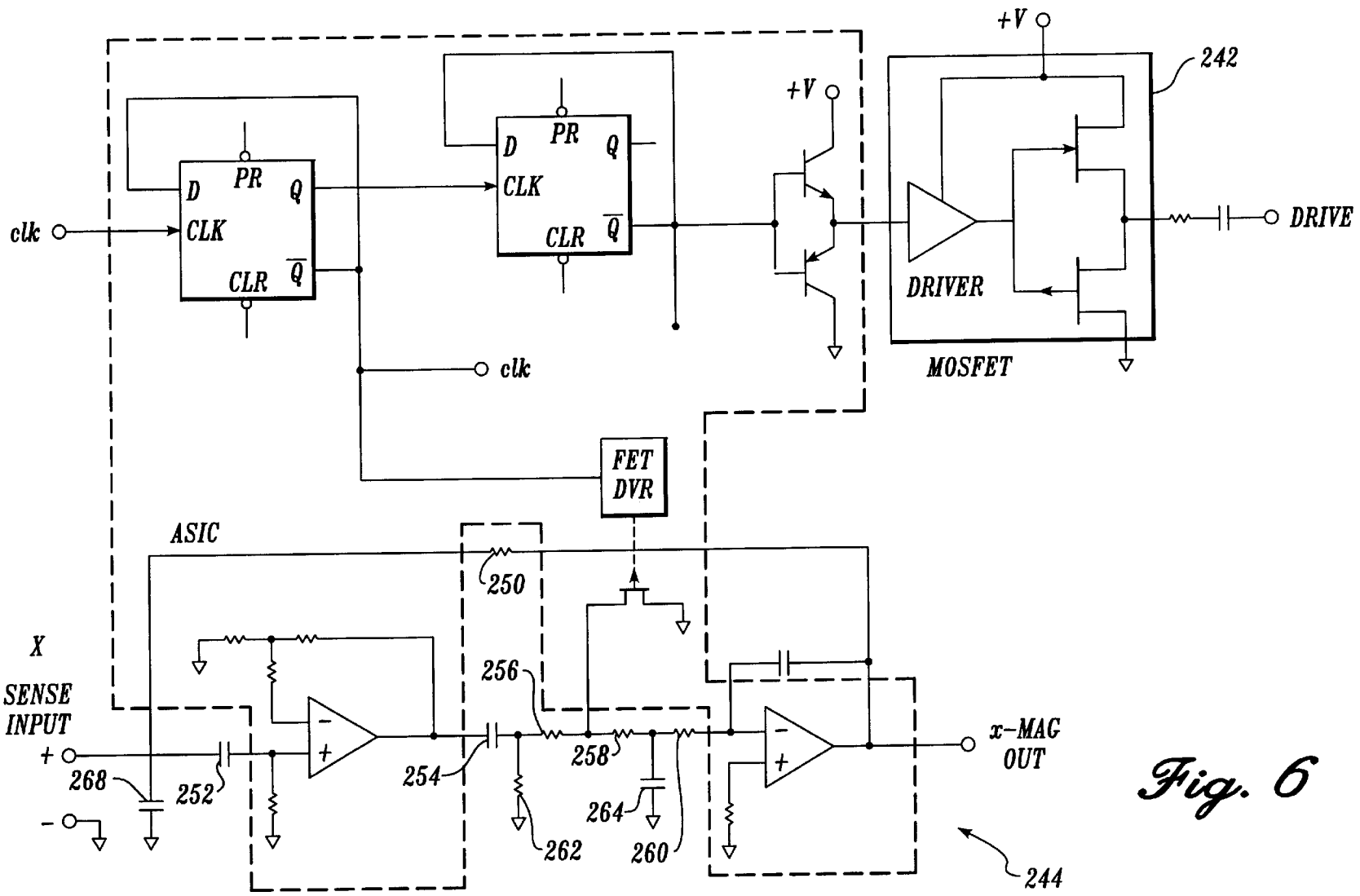
FIG. 6 illustrates a current feed-back circuit in the magnetometer integrated drive circuit according to an embodiment of the present invention.
Figure 7:
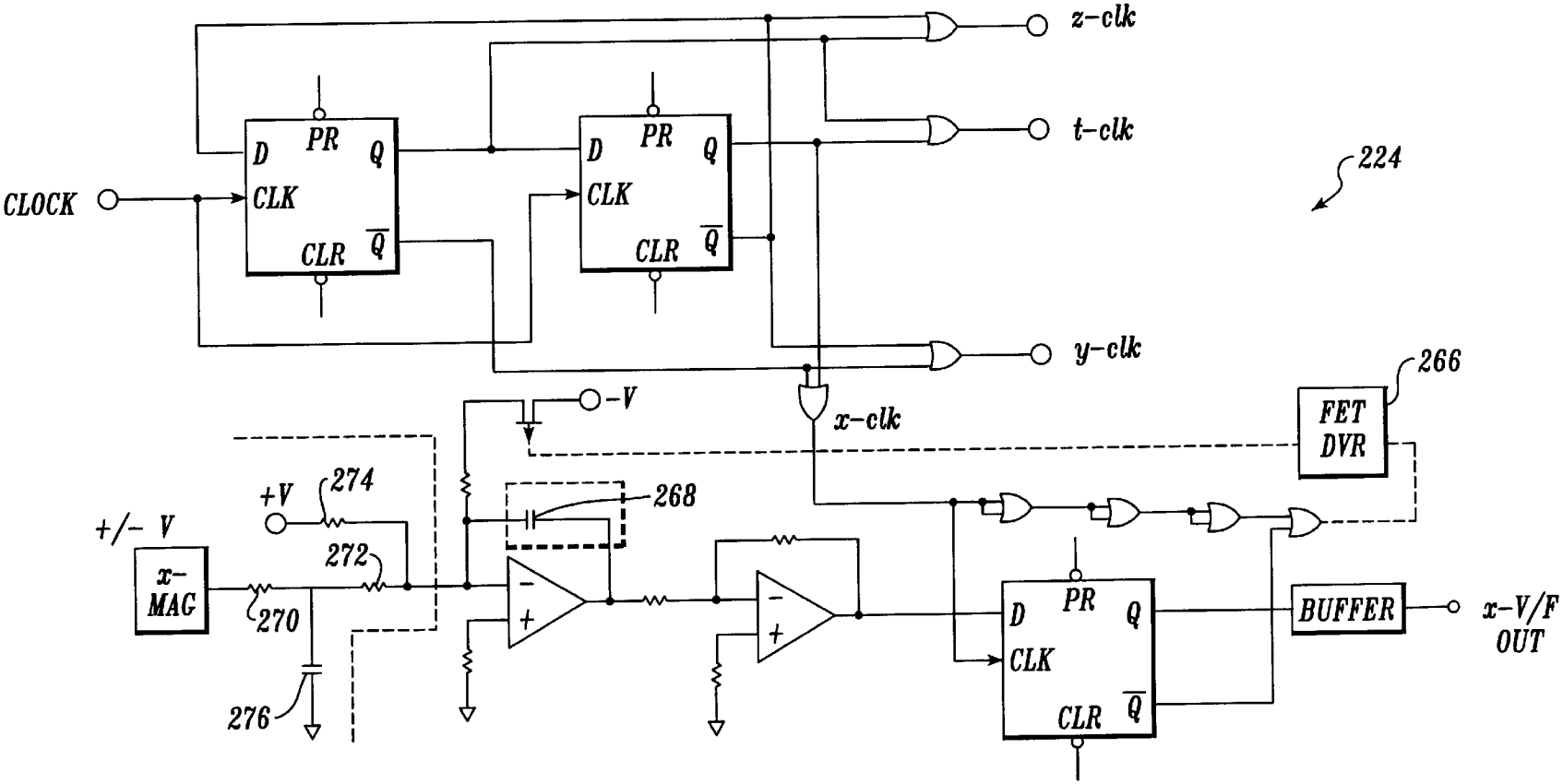
FIG. 7 illustrates a conventional voltage-to-frequency converter.

FIGS. 6 and 7 describe magnetometer integrated control circuit 218. In the present invention, magnetometer 54 provides drive and sense circuits which avoid the penalties previously associated with miniaturization. The use of micro-electronics aids in reducing the size and enhancing the reliability of magnetometer 54. The use of integrated digital circuit 210 and magnetometer integrated control circuit 218 to drive the ring core contribute to the enhanced performance of magnetometer 54 by reducing power consumption and noise. Additionally, use of application specific integrated circuits improves modeling characteristics. For example, application specific integrated circuits have more uniform characteristics than circuits implemented using discrete packaged integrated circuits. Reliability is enhanced, for example, because this smaller unitary electronics package may be more effectively shock and vibration mounted than discrete packaged integrated circuits on a printed wiring board. Use of application specific integrated circuits further improves reliability by providing multiple functions in a single integrated circuit. In a failure mode and effects analysis (FMEA), the statistical probability of a single component failing is far less than the probability of failure associated with the same circuit implemented using multiple discrete components.

The size of magnetometer 54 is reduced by co-locating the sensor and associated electronic circuits which, in turn, allows miniaturization of directional indication system 18. Miniaturized directional indication system 18 is suitable for a wider range of applications. For example, one alternative configuration for other applications is described in detail with reference to FIG. 15.

Modern ceramic substrate and direct chip attach (DCA) methods provide a dense electronic assembly in contrast to current technology which uses discrete packaged integrated circuits on a printed wiring board manufactured using either surface mount or through-hole technology. The use of direct chip attach technology allows development of ASICs for controlling the sensor signals and creating a digital controller. For example, integrated control circuit 218, which provides the sensor drive and sense functions for all three axes and digital temperature channel 248, detailed in FIGS. 6 through 8, may be implemented in chip form as a magnetometer ASIC 218.

Magnetometer 54 includes three orthogonally directed sensors controlled by magnetometer integrated control circuit 218. Magnetometer integrated control circuit 218 drives a current which induces a magnetic field in each axis of magnetometer 54. A MOSFET current driver 242 saturates ring core magnetometer 54 sensors according to a command from magnetometer integrated control circuit 218. The current induced magnetic field interacts with Earth's natural magnetic field. Earth's natural magnetic field adds to or subtracts from the magnetometer's current induced field such that the magnetometer becomes over balanced. Integrated control circuit 218 provides feedback signals to balance magnetometer sensors 54.

The invention includes magnetometer drive and sense electronics enhanced through integration with directional indication system 18 micro-electronics. Integrated control circuit 218 includes integrated four channel voltage-to-frequency converter 224 for analog-to-digital conversion. Three channels of voltage-to-frequency converter 224 convert the analog magnetometer signals from the X-axis, Y-axis and Z-axis sensors to digital signals. A fourth channel is a digital temperature channel used for thermally modeling performance characteristics of directional indication instrument 18.

FIG. 6 illustrates a conventional current feed-back circuit in magnetometer integrated drive circuit 244 which provides a measured amount of current to the X-axis sensor of magnetometer 54 to restore the magnetometer's balance, also called "nulling" the sensed Earth's field. The restoring or nulling current signal is a measure of the intensity and direction of the local Earth's magnetic field. The restoring or nulling current signal is changed to a voltage signal through a scaling resistor 250 in magnetometer integrated drive circuit 244.

According to one aspect of the invention, the advantages of micro-electronics are realized in magnetometer integrated drive circuit 244. For example, in one preferred embodiment, magnetometer integrated drive circuit 244 for the X-axis magnetometer sensor illustrated in FIG. 6 is implemented in combination with equivalent magnetometer drive circuits for the Y-axis and Z-axis magnetometer sensors in magnetometer ASIC 218, exclusive of, for example, MOSFET current driver 242, scaling resistor 250, coupling capacitors 252, 254, input resistors 256, 258, 260, grounding resistor 262 and grounding capacitors 264, 268.

FIG. 7 illustrates the voltage-to-frequency converter portion 224 of magnetometer control circuit 218. Voltage-to-frequency converter 224, shown for the X-axis channel, is a conventional voltage-to-frequency converter circuit which converts the voltage output signal of magnetometer 54 to a frequency signal. The invention includes equivalent voltage-to-frequency converter circuits for the Y-axis channel and the Z-axis channel. Voltage-to-frequency converter 224 also includes a fourth voltage-to-frequency converter for a digital temperature channel.

Voltage-to-frequency converter 224, shown for the X-axis channel in FIG. 7, may be implemented in combination with similar voltage-to-frequency converters for the Y-axis and Z-axis channels in another ASIC. Alternatively, voltage-to-frequency converters 224 for all three axes may be combined with magnetometer integrated drive circuits 244 for all three axes in single magnetometer ASIC 218. For example, in one preferred embodiment, X, Y and Z-axes voltage-to-frequency converters 224 are implemented in single magnetometer ASIC 218 in combination with X, Y and Z-axes magnetometer integrated drive circuits 244, including FET drivers 266. In one embodiment, voltage-to-frequency converters 224 are integrated into magnetometer ASIC 218 exclusive of, for example, feedback capacitors 268, magnetometer output resistors 270, 272, power input resistors 274 and grounding capacitors 276.

Figure 8:
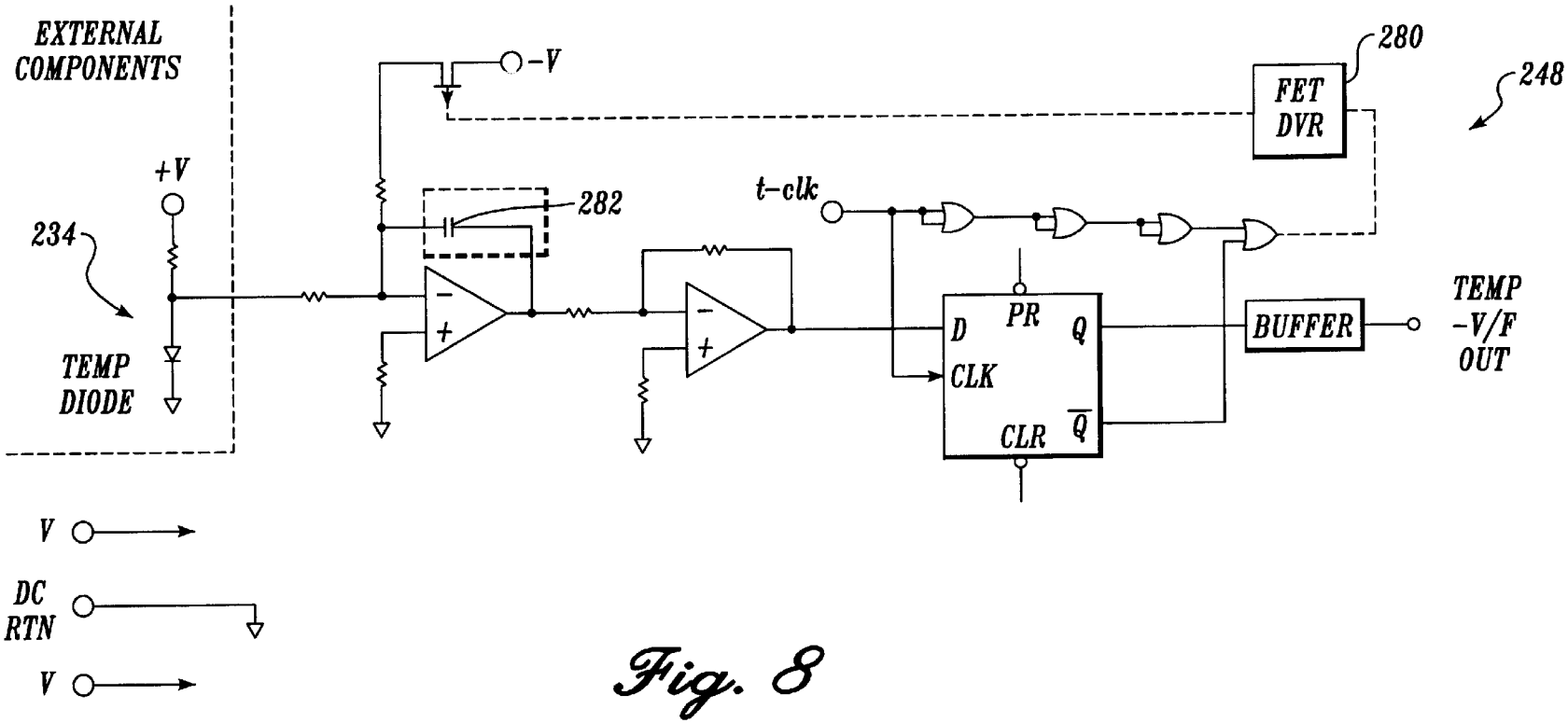
FIG. 8 illustrates a digital temperature channel according to an embodiment of the present invention.

FIG. 8 illustrates a frequency temperature channel 248 according to the invention where the temperature diode 234 is mounted external to integrated control circuit 218. Magnetometer ASIC 218 may also integrate digital temperature channel 248 circuit illustrated in FIG. 8, including FET driver 280. In one embodiment, digital temperature channel 248 is integrated into magnetometer ASIC 218 exclusive of, for example, feedback capacitor 282, and temperature diode 234.

Accelerometer

According to one embodiment of the present invention, three linear accelerometers 56*a*, 56*b*, 56*c* shown in FIG. 2 utilizing micro-machined silicon sensors are used in directional indication instrument 18. In the preferred embodiment, micro-machined sensors comprise vibrating beam accelerometers. These sensors output acceleration signals as a variable frequency having a change from a nominal resonance which is proportional to the sensed acceleration. The vibrating beam provides for extremely stable scale factor and, because the signal is already in the digital domain, ease of signal use. An integrated circuit known in the art provides signal conditioning of the acceleration sensors. Vibrating beam acceleration sensing mechanisms formed of silicon are inherently less sensitive to the high shock and vibration levels of the downhole drilling environment than are other types of acceleration sensors. Silicon maintains excellent operational properties at the extremely high temperatures of deep wells.

Figure 9:
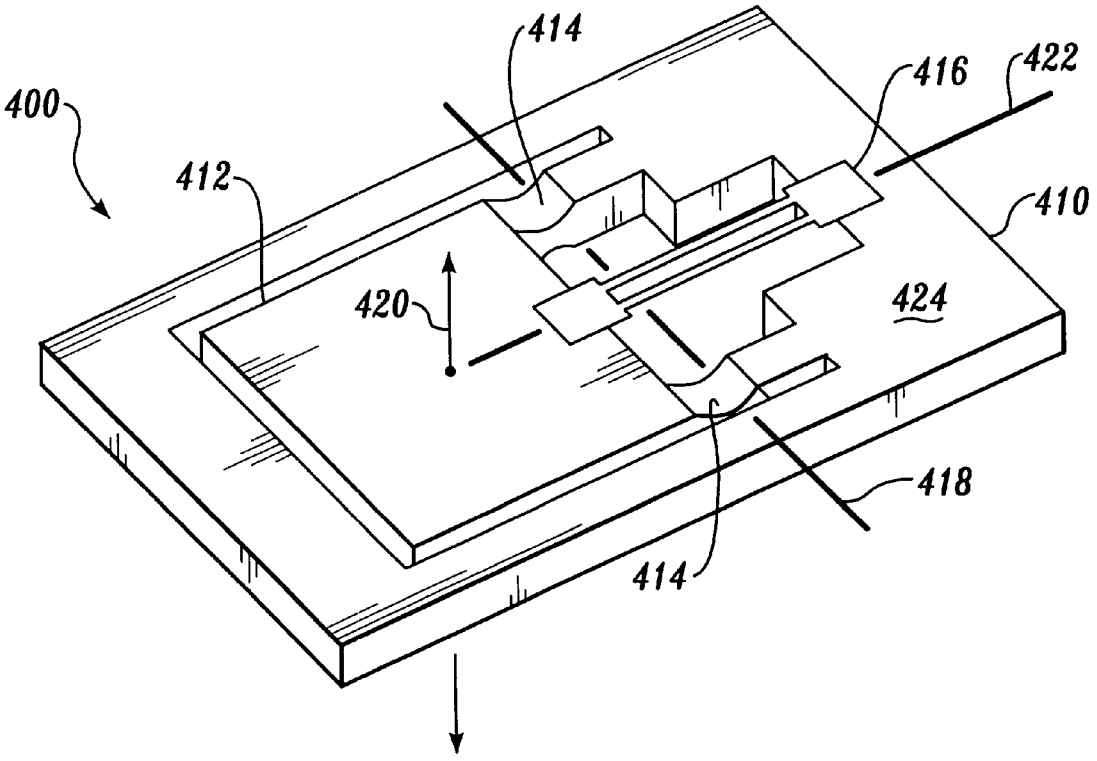
FIG. 9 illustrates by example a silicon acceleration sensing mechanism.

FIG. 9 illustrates by example a vibrating beam acceleration sensing mechanism 400. A typical vibrating beam acceleration sensing mechanism comprises a frame 410 formed of a suitable substrate material, for example, silicon or quartz. A reaction mass or proof mass 412 is rotatably suspended from frame 410 by one or more hinges 414. One or more force sensing transducers 416 are suspended between frame 410 and reaction mass 412. Frame 410 is mounted on a suitable platform leaving reaction mass 412 limited space to rotate about hinge axis 418 in response to a force input along an input axis 420 normal to the plane of reaction mass 412. As reaction mass 412 rotates relative to frame 410 in response to a force experienced along input axis 420, force sensing transducer 416 experiences either a compressive or tensile force along its longitudinal axis 422. In other words, force sensing transducer 416 is either compressed or stretched between frame 410 and reaction mass 412 when reaction mass 412 is displaced or rotated away from a null position relative to frame 410.

Often, two force sensing transducers 416 are used in order to reduce or eliminate common mode effects. When two force sensing transducers 416 are used, the two transducers are mounted such that displacement or rotation of reaction mass 412 places a first transducer into compression while placing the second transducer into tension. For example, when a first force sensing transducer 416 is mounted on an upper surface 424 of frame 410, a second force sensing transducer (not shown) may be mounted on the opposite surface of frame 410. Other configurations wherein a first and second force sensing transducer are mounted such that displacement or rotation of reaction mass 412 places the first transducer into compression and places the second transducer into tension are known to those of skill in the art. For example, several alternate configurations are described in U.S. Pat. No. 5,005,413, which is incorporated herein by reference.

Micro-machined silicon acceleration sensor 400 provides an acceleration signal output as a variable frequency having a change from a nominal resonance proportional to the sensed acceleration. In other words, when reaction mass 412 of FIG. 9 is displaced or rotated relative to frame 410 in response to an acceleration input, force sensing transducer 416 is placed into either compression or tension. The natural frequency of force sensing transducer 416 changes when force sensing transducer 416 is compressed or stretched: the natural frequency of force sensing transducer 416 decreases below a nominal resonance when transducer 416 is compressed and increases above a nominal resonance when transducer 416 is stretched. The resulting change in frequency is proportional to the force or acceleration applied to reaction mass 412. This push/pull phenomenon is extensively described in U.S. Pat. No. 5,005,413.

Figure 10:
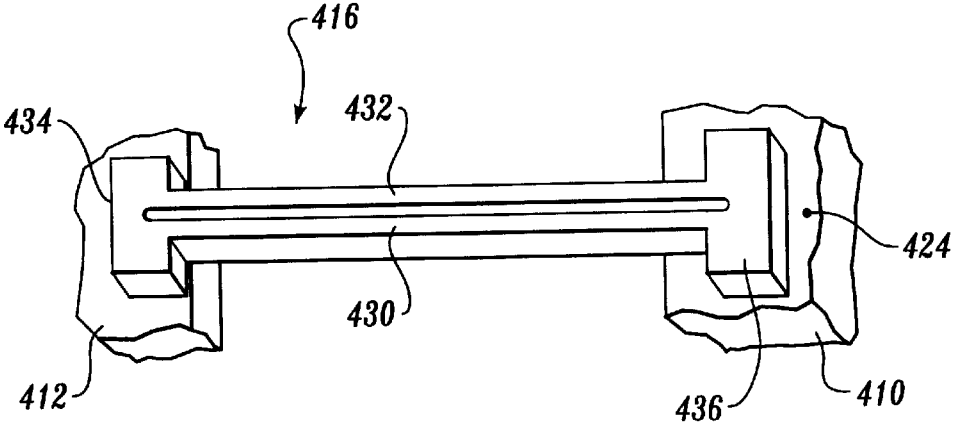
FIG. 10 illustrates by example a two tine vibrating beam force sensing transducer.

FIG. 10 is a detailed example of two tine vibrating beam force sensing transducer 416. Micromachined silicon acceleration sensors often employ vibrating beam force sensing transducers of, for example, the general configuration shown in FIG. 10. Transducer 416 comprises two tines 430, 432 attached to mounting tabs 434, 436. Tines 430, 432 are adapted to vibrate or oscillate at their respective natural frequencies in response to a drive signal applied by a drive circuit.

Figure 11:
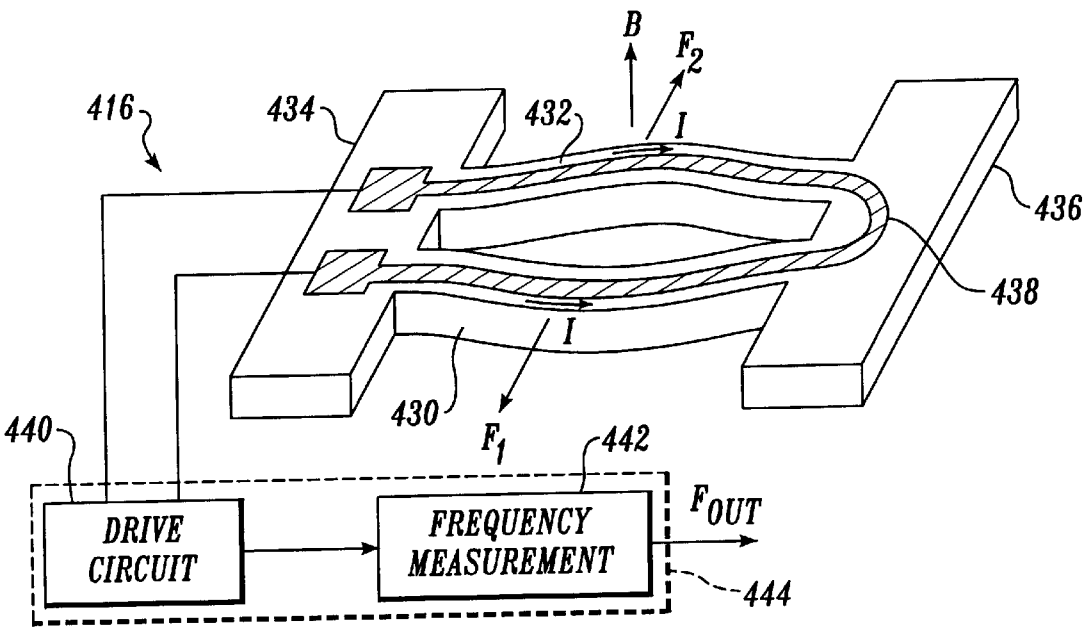
FIG. 11 illustrates the mechanical operation of a two tine vibrating beam force sensing transducer.

FIG. 11 illustrates the mechanical operation of transducer 416. Various methods of inducing oscillation in tines 430, 432 are known. For example, tines 430, 432 may be adapted to accept an electrical current by forming tines 430, 432 in a semiconducting material, for example, doped conductive polysilicon. In another example, electrically conductive film electrode 438 may be deposited on a surface of tines 430, 432 as shown in FIG. 11. Vibration or oscillation of tines 430, 432 may be accomplished by various means. For example, in a typical magnetic drive sensor, tines 430, 432 are mounted within the field, B, of one or more permanent magnets. The drive circuit 440 applies an oscillating or alternating current, I, in electrically conductive film electrode 438 which induces a sympathetic alternating magnetic field within conductive film electrode 438. The alternating or oscillating current-induced magnetic field in conductive film electrode 438 interacts with the field, B, of the permanent magnets to create forces, $F_1$ and $F_2$, which drive tines 430, 432 into oscillation. In an alternate configuration (not shown), force sensing transducer 416 may be manufactured having four tines. In a four tine transducer, the sensing circuit may comprise two pair of driven and sensed tines, each pair comprising an inner tine and an outer tine as described in U.S. Pat. Nos. 5,367,217 and 5,331,242, both incorporated herein by reference.

Figure 12:
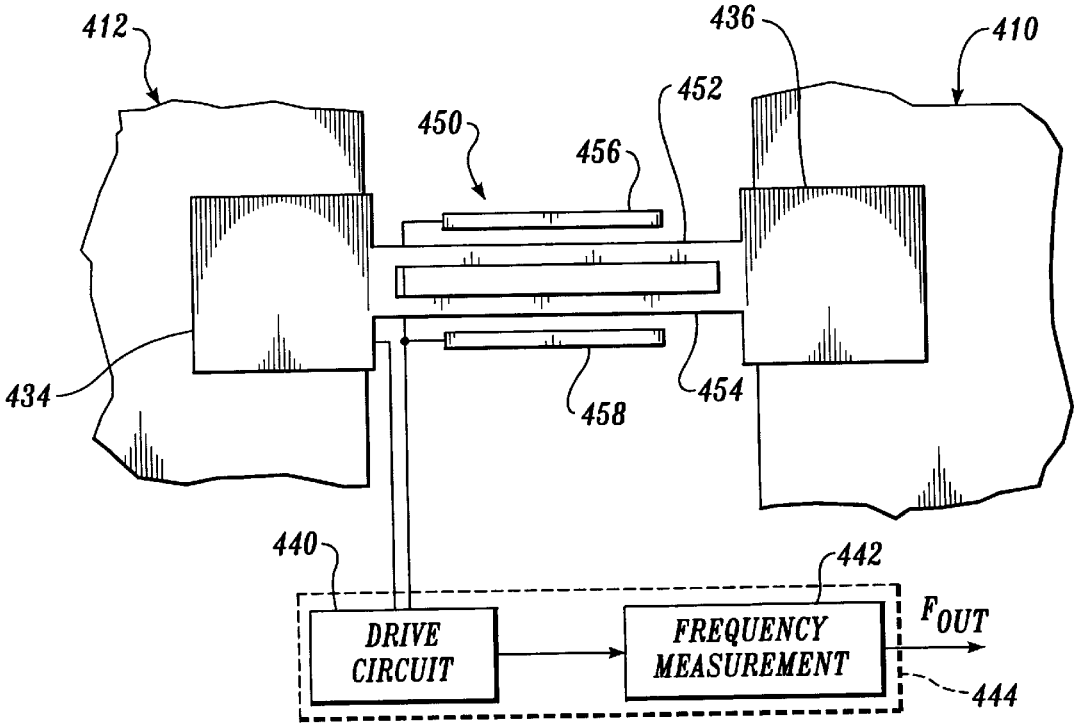
FIG. 12 illustrates an electrostatic drive vibratory accelerometer system.

Alternatively, the invention may be practiced using an electrostatic or capacitive drive vibratory system 450 as illustrated in FIG. 12. In the embodiment of FIG. 12, tine oscillation may be driven by inducing alternating or oscillating electrostatic forces between electrically conductive surfaces on tines 452, 454 and adjacent conductors 456, 458 mounted on frame 410 adjacent to and coextensive with conductive surfaces on tines 452, 454. Electrostatically driven dual vibrating beam force transducers are known in the art and are disclosed in U.S. Pat. Nos. 4,901,586 and 5,456,111 and co-pending U.S. patent application Ser. No. 08/651,927 entitled "Electrostatic Drive For Accelerometer" filed May 5, 1996, and commonly assigned to the assignee of the present application, all incorporated herein by reference. Other examples of micro-machined silicon acceleration sensors which may be used with the present invention are described in U.S. Pat. Nos. 4,766,768 and 5,241,861, both incorporated herein by reference.

The performance of accelerometers 56*a*, 56*b*, 56*c* is enhanced by closely matching the thermal expansion coefficients of the package material and the silicon acceleration sensor mechanism. This thermal expansion coefficient match reduces the strain induced into the silicon sensor mechanism over the extreme temperature range of operation. Reduced strain increases sensor accuracy or performance.

Figure 13:
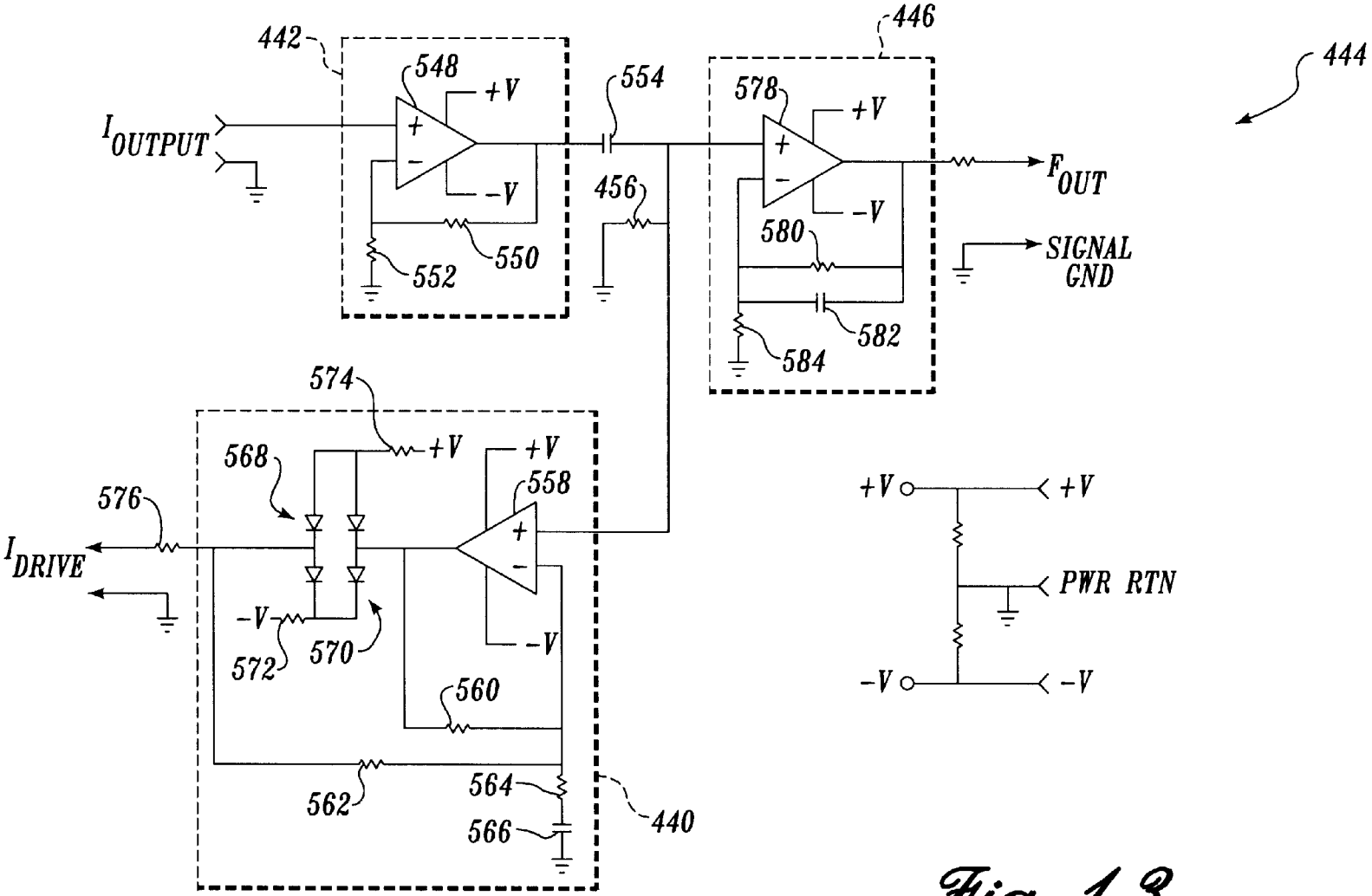
FIG. 13 illustrates an accelerometer circuit, including accelerometer drive and sense circuits.

The acceleration sensors further incorporate microelectronics to provide the sensor drive and sensing functions. FIG. 13 illustrates a simplified example of a conventional accelerometer circuit 444 commonly used with a conventional single vibrating beam acceleration sensor. A sensing or frequency measurement circuit 442 senses the change in frequency of tines 430, 432 when tines 430, 432 are stretched or compressed and reduces the sensed frequency change to an accelerometer output signal, $F_{out}$.

Acceleration circuit 444 includes drive circuit 440 and sensing circuit 442. Accelerometer circuit 444 is essentially doubled when dual force sensing transducers 416, tension and compression transducers, are used.

In the example of FIG. 12, electrodes 438 formed on vibrating tines 430, 432 of force sensing transducer 416 accept a drive current, $I_{DRIVE}$, from drive circuit 440 and return an output current, $I_{OUTPUT}$, to sensing circuit 442 which is proportional to acceleration. Output current, $I_{OUTPUT}$, is applied to sensing circuit 442 which includes operational amplifier 548, feedback resistor 550 and grounding resistor 552. Sensing circuit 442 converts output current, $I_{OUTPUT}$, to a corresponding voltage. Coupling capacitor 554 removes any DC bias before applying the voltage output of sensing circuit 442 to filter 446, drive circuit 440 and to ground through grounding resistor 456.

In order to create an oscillator, the output of sensing circuit 442 is fed back into electrodes 438 by way of drive circuit 440. Drive circuit 440 includes an operational amplifier 558, feedback resistors 560, 562, grounding resistor 564, and grounding capacitor 566. Voltage limiting is provided by two pairs of serially connected diodes 568, 570 coupled to + and – voltage through input resistors 572, 574. The output of drive circuit 440 is applied to transducer electrodes 438 through an input resistor 576.

The voltage output of sensing circuit 442 is fed to filter 446 which includes operational amplifier 578, feedback resistor 580 and capacitor 582, and grounding resistor 584. Filter circuit 446 subtracts a quadriture signal from the output of sensing circuit 442 by applying the output signal to the inverting and non-inverting inputs of operational amplifier 578. Application of the output of sensing circuit 442 to filter 446 also optimizes the operation of drive circuit 440 by eliminating unnecessary voltage levels. A more detailed explanation of a conventional accelerometer circuit is presented in U.S. Pat. No. 5,456,111, which is incorporated herein by reference.

Micro-electronics allow additional size reduction and enhance the shock and vibration capability of accelerometers 16*a*, 16*b*, 16*c*. Accelerometer circuit 444, including drive circuit 440, sensing circuit 442 and filter 446 may be implemented in one or more application specific integrated circuits in order to realize the size reduction and enhanced shock and vibration capability associated with the use the of a micro-electronics package. The micro-electronics of accelerometers 16*a*, 16*b*, 16*c* and direction sensor system 18 of the present invention perform acceptably at an elevated temperature of 200 degrees Centigrade for continuous periods. In contrast, typical discrete packaged electronics breakdown during operation at high temperatures in excess of 150 degrees Centigrade.

The acceleration sensors used in one embodiment of the present directional indication instrument incorporate modern ceramic packaging technology which integrates the mechanical and electrical signal routing of the acceleration sensor. The ceramic packaging technology results in an acceleration sensor which is smaller and inherently shock and vibration survivable.

Generally, directional indication instrument 18 may be practiced using, for example, an accelerometer of the type described in co-pending application Application Ser. No. 60/068,022 entitled "Silicon Micro-machined Accelerometer Using Integrated Electrical And Mechanical Packaging," filed on the same day herewith, in the name of the same inventor as the present application and similarly assigned to the same assignee, which is incorporated herein by reference.

Figure 14:
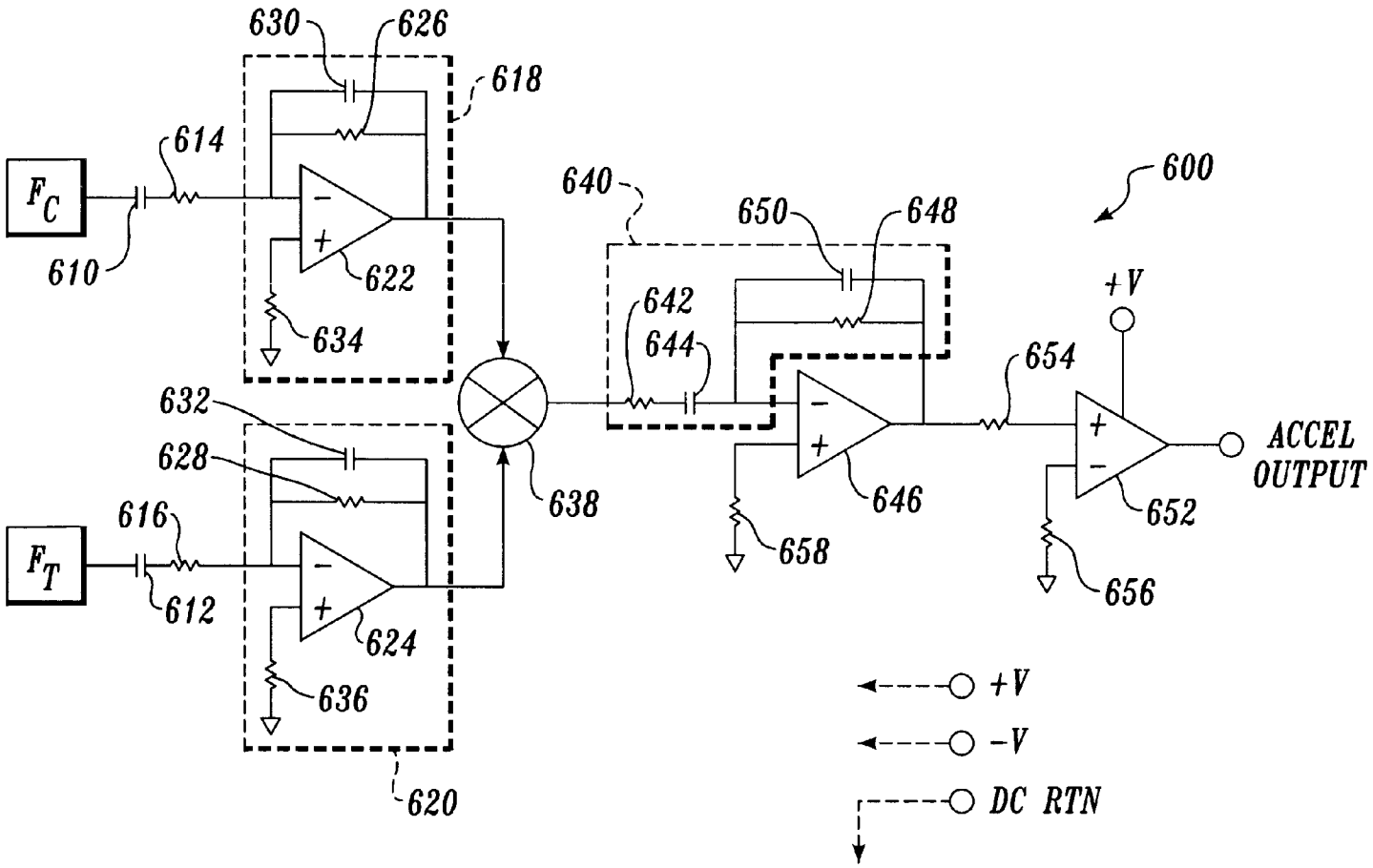
FIG. 14 illustrates a mixer/filter section of an accelerometer circuit.

FIG. 14 illustrates the mixer/filter section 600 of accelerometer circuit 200. The outputs of accelerometers 56*a*, 56*b*, 56*c* are routed to mixer/filter section 600 of accelerometer circuit 200. The output signals of vibrating beam accelerometers 56 are in the frequency domain which is a pseudo-digital domain. Accelerometer 56 outputs include the output of the compression transducer, $F_C$, and the tension transducer, $F_T$, which are fed to accelerometer circuit 444 at mixer/filter section 600 via flexible circuit interconnect 66. Mixer/filter 600 includes coupling capacitors 610, 612 and resistors 614, 616 at the transducer inputs. The transducer inputs are fed to transimpedence amplifiers 618, 620 which include operational amplifiers 622, 624, feedback resistors 626, 628 and capacitors 630, 632, and grounding resistors 634, 636. The outputs of transimpedence amplifiers 618, 620 are coupled to mixer 638 where the signals are heterodyne mixed. The mixed signal is filtered in filter 640 to extract the difference signal frequency which is proportional to the acceleration experienced by accelerometer 56. Filter 640 includes an input resistor 642 and capacitor 644 and operational amplifier 646 with feedback resistor 648 and capacitor 650 which may be in the form of a resistor-capacitor network. The output of operational amplifier 646 is applied to a second operational amplifier 652 via input resistor 654. Each operational amplifier 646, 652 is tied to ground through a grounding resistor 656, 658. The output is squared and applied to integrated digital circuit 210 for counting over the selected sample rate and outputting via UART 212.

Alternative Embodiments

Those of skill in the art will appreciate that the structure of the present miniature directional indication instrument is not limited to a well drilling instrument or to the energy exploration industry. Other uses for an instrument practiced according to the present invention include, but are not limited to, directional indication for tunneling, either near the surface or deep in the ground, methane gas and air tube drilling in mineral mines, for example coal mines, and as a general heading indication instrument for navigational uses.

A preferred alternative embodiment of the present invention comprises a compact cubical format for use as a navigational aide. The compact cubical format embodiment configures the sensors and electronics into a minimal space for integration with other navigational sensors in an integrated inertial navigation system for airborne, spaceborne, land or marine based vehicles.

Figure 15:
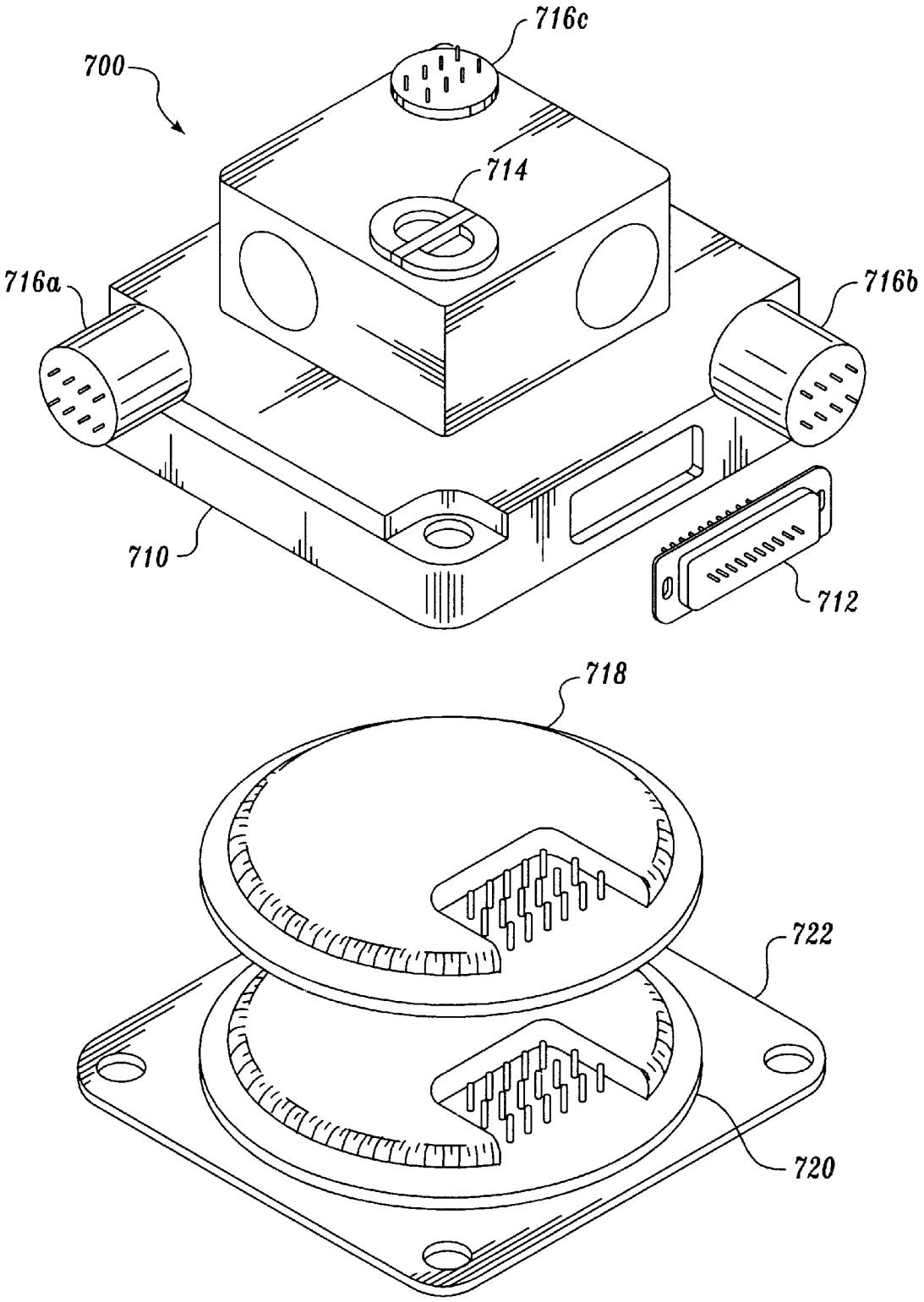
FIG. 15 illustrates an alternative embodiment of the present invention in compact cubical format.

FIG. 15 illustrates an exemplary embodiment of the present invention in a compact cubical format. Directional sensing system 700 includes chassis 710 which is sized such that overall sensor system dimensions, inclusive of an electronic connector 712 for inputting power and outputting sensor signals, are minimized. A single sturdy, reliable chassis mount improves vibration and shock or impact operational and survival capability.

Directional sensing system 700 comprises three axis magnetometer 714 mounted in one of the three orthogonal axes of chassis 710. X-axis, Y-axis and Z-axis accelerometers 716*a*, 716*b*, 716*c* are mounted in each of three orthogonal axes of chassis 710. A cover (not shown) protects the sensors from exposure to the environment. Directional sensor system 700 includes a main electronics package 718 which controls the functions of directional sensing system 700. Main electronics package 718 provides serial digital output signals of accelerometers 716*a*, 716*b*, 716*c* and three-axis magnetometer 714; a temperature signal output; and a status word. Main electronics package 718 and power regulation electronics package 720 are mounted within the base of chassis 710. Main electronics package 718 and power regulation electronics package 720 are protected from the environment by cover plate 722. A flexible circuit interconnect (not shown) routes the input power and sensor output signals among the various system components.

According to yet another aspect of the present invention, micro-electronics are utilized to improve the reliability of the sensor system's electronic features, including main electronics package 718. Similarly, system power regulation electronics package 720, including power regulation, isolation, and filtering functions, are implemented in one or more hybrid electronics packages.

What is claimed is:

1. A miniature directional indication instrument comprising:

a chassis; and an electronics module implemented in a ceramic substrate and coupled to said chassis.

2. The miniature directional indication instrument of claim 1 further comprising two triads of directional sensors coupled to said electronics module.

3. The miniature directional indication instrument of claim 2 wherein one of said triads of directional sensors is a triad of magnetometers.

4. The miniature directional indication instrument of claim 3 wherein said triad of magnetometers comprises co-located drive and sense electronics implemented in a ceramic substrate.

5. The directional indication instrument of claim 2 wherein one triad of said triads of directional sensors comprises three linear accelerometers.

6. The directional indication instrument of claim 5 wherein said accelerometers comprise package material and sensor mechanisms.

7. The directional indication instrument of claim 6 wherein said sensor mechanisms comprise ceramic packaging, said ceramic packaging providing integrated mechanical and electrical signal routing in said accelerometers.

8. The directional indication instrument of claim 5 wherein said accelerometers are vibrating beam accelerometers.

9. The directional indication instrument of claim 5 wherein said accelerometers are micro-machined silicon accelerometers.

10. The miniature directional indication instrument of claim 1 wherein said electronics module is further implemented in an integrated low temperature co-fired ceramic substrate.

11. The miniature directional indication instrument of claim 1 further comprising a plurality of electronic assemblies, wherein said electronic assemblies are multichip module electronic assemblies implemented in an integrated low-temperature co-fired ceramic substrate, said assemblies coupled to said electronics module.

12. A miniature directional indication instrument comprising:

a chassis;

a triad of magnetometers with integrated drive and sense electronics implemented on a ceramic substrate;

a triad of vibrating beam accelerometers comprising ceramic packaging and coupled to said chassis;

a main system electronics module implemented in a ceramic substrate and operably coupled to said triad of magnetometers and said triad of accelerometers; and a power regulator electronics assembly implemented in a ceramic substrate, and operably coupled to said main system electronics module.

13. A chassis for mounting directional sensors in a miniature direction indication instrument comprising:

a first mount for a first linear accelerometer;

a second mount for a second linear accelerometer, said second mount oriented orthogonally to said first mount; and a third mount for a mutually orthogonal three axis magnetometer.

14. The chassis of claim 13 wherein said chassis is formed of a single piece.

15. The chassis of claim 13, further comprising an indexing plug for aligning the reference axes of the directional sensors with external equipment.

* * * * *